United States Patent [19]

D'Amato et al.

[11] 4,195,248

[45] Mar. 25, 1980

[54] COLOR PICTURE TUBE HAVING IMPROVED CORRUGATED MASK

[75] Inventors: Ralph J. D'Amato; Robert P. Stone, both of Lancaster, Pa.

[73] Assignee: RCA Corporation, New York, N.Y.

[21] Appl. No.: 940,577

[22] Filed: Sep. 8, 1978

[51] Int. Cl.[2] ..... H01J 29/07

[52] U.S. Cl. ..... 313/403

[58] Field of Search ..... 313/403, 408

[56] References Cited

U.S. PATENT DOCUMENTS

| | | | |
|---|---|---|---|
| 4,072,876 | 2/1978 | Morrell | 313/403 |
| 4,122,368 | 10/1978 | Masterton | 313/403 |
| 4,136,300 | 1/1979 | Morrell | 313/403 |
| 4,146,816 | 3/1979 | Morrell | 313/403 |

*Primary Examiner*—Robert Segal

*Attorney, Agent, or Firm*—Eugene M. Whitacre; Glenn H. Bruestle; Dennis H. Irlbeck

[57] ABSTRACT

An improvement is provided in an apertured mask type color picture tube having a substantially flat faceplate, a cathodoluminescent screen on the faceplate, a corrugated apertured mask adjacent the screen and electron gun means for producing and directing a plurality of electron beams through the mask to impinge upon the screen. The mask corrugations are substantially parallel and extend in a first direction with the varying corrugated waveform extending in a second direction. The mask includes an aperture width and/or an aperture-to-aperture spacing variation in the second direction which is a function of mask-to-screen spacing. The improvement comprises a further variation in aperture width and/or aperture-to-aperture spacing which is a function of (a) deflection angle of the electron beams, (b) the angle in a horizontal plane between tangents to the mask surface and a central contour through the mask, and (c) the angle in a horizontal plane between a tangent to the mask central contour and a plane perpendicular to the tube central longitudinal axis. In an additional improvement, aperture width also is varied because of the effective mask thickness or aperture step height.

10 Claims, 12 Drawing Figures

$$\frac{b}{a} = \cos(\theta_H + \alpha - \beta_{MH})$$

$$\frac{b}{a'} = \cos\theta_H$$

$$\frac{a}{a'} = \frac{\cos\theta_H}{\cos(\theta_H + \alpha - \beta_{MH})}$$

BUT $a' = \dfrac{3q'S}{L}$ $$\therefore\ a = \frac{3q'S}{L} \cdot \frac{\cos\theta_H}{\cos(\theta_H + \alpha - \beta_{MH})}$$

COLOR PICTURE TUBE HAVING IMPROVED CORRUGATED MASK

BACKGROUND OF THE INVENTION

This invention relates to shadow mask type color picture tubes, and particularly to variations in the aperture patterns of shadow masks within such tubes having corrugated shadow masks.

In a shadow mask tube, a plurality of convergent electron beams are projected through a multi-apertured color selection electrode or shadow mask to a mosaic screen. The beam paths are such that each beam impinges upon and excites only one kind of color-emitting phosphor on the screen while being shielded from the different color-emitting phosphors by the shadow mask.

Presently, all commercial color picture tubes have front panels or viewing faceplates that are either spherical or cylindrical, with corresponding somewhat spherical or cylindrical shadow masks. In a recently suggested color picture tube disclosed in U.S. Pat. No. 4,072,876, issued to A. M. Morrell On Feb. 7, 1978, a mask corrugated in the horizontal direction is incorporated in combination with a flat or substantially flat faceplate. The apertures of the corrugated mask are slit-shaped and are aligned in vertical columns. In order to keep acceptable nesting of the phosphor lines comprising the screen, the horizontal spacing between aperture columns and/or aperture width are varied as functions of the spacing between the mask and the screen. The present invention recognizes this prior art spacing dependence of aperture width and aperture column-to-aperture column spacing and provides other variations in these parameters to correct obliquity problems related to the angle an electron beam makes with respect to the mask surface, thereby maintaining a desired brightness when the phosphor screen is excited.

SUMMARY OF THE INVENTION

The foregoing prior art type color picture tube having a corrugated mask, wherein the mask includes aperture width and/or aperture-to-aperture spacing variations which are functions of mask-to-screen spacing, is improved by providing a further modification of aperture width and/or aperture-to-aperture spacing which is a function of electron beam angle of incidence relative to the mask. In an additional improvement, aperture width is further modified because of the effective mask thickness or aperture step height.

DESCRIPTION OF THE PREFERRED EMBODIMENTS

Figure 1:
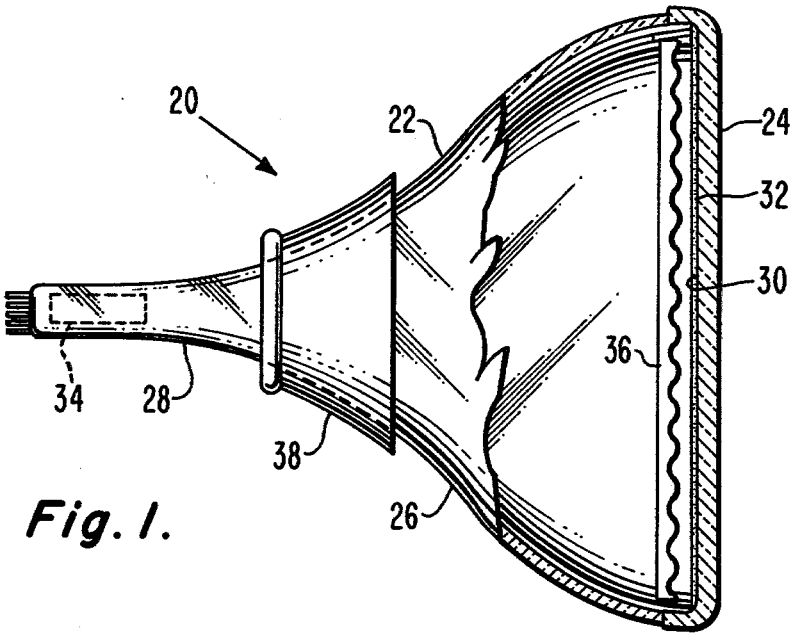
FIG. 1 is a partially cut-away top view of a color picture tube having a flat faceplate and a corrugated mask.

FIG. 1 illustrates an apertured-mask color television picture tube 20 comprising an evacuated glass envelope 22 including a substantially rectangularly-shaped flat faceplate panel 24, a funnel 26, and a neck 28. A three-color phosphor-viewing screen 30 is supported on the inner surface 32 of the faceplate panel 24. An electron-gun assembly 34, positioned in the neck 28, includes three electron guns (not shown), one for each of the three color phosphors on the viewing screen 30. A corrugated apertured mask 36 is positioned in the envelope 22 adjacent the viewing screen 30. The electron-gun assembly 34 is adapted to project three electron beams through the apertured mask 36 to strike the viewing-screen structure 30 with the mask 36 serving as a color selection electrode. A magnetic deflection yoke 38 is positioned on the envelope 22 near the intersection of the funnel 26 and the neck 28. When suitably energized, the yoke 38 causes the electron beams to scan the screen 30 in a rectangular raster.

Figure 2:
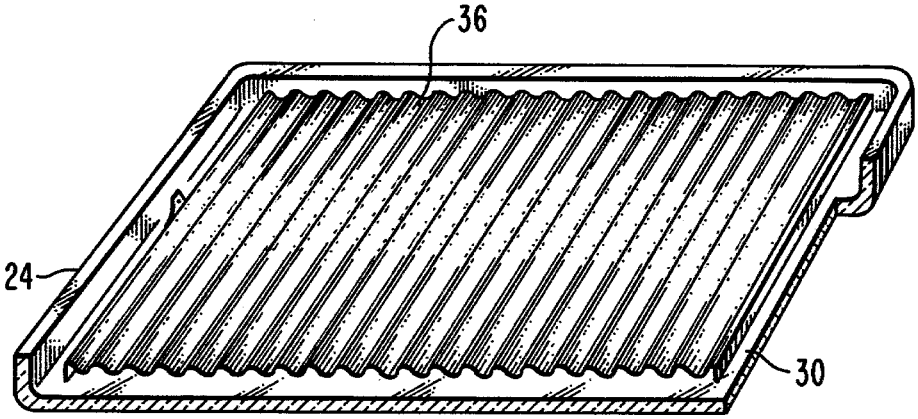
FIG. 2 is a perspective view of the mask-faceplate assembly of the tube of FIG. 1.

The apertured mask 36 further depicted in FIG. 2, is corrugated or somewhat sinusoidally curved along the horizontal or major axis (in the direction of the longer dimension of the mask) with the corrugations extending vertically in the direction of the minor axis (between long sides of the mask or in the direction of the shorter dimension of the mask). It should be understood that the term corrugated is herein defined broadly to include various shapes including sawtooth waveforms as well as sinusoidal shapes. Although the mask 36 is shown without any curvature along its major and minor axes, it should be understood that a mask having the same or different curvatures along these axes also is included within the scope of the present invention. Similarly, while the faceplate panel is shown as flat, it should be understood that it too may be curved along both major and minor axes.

The mask 36 includes a plurality of slit-shaped apertures aligned in vertical columns. In order to keep an acceptable line pattern on the screen, that is, to maintain the desired brightness level and the desired spacing or nesting between the phosphor lines, aperture width and the horizontal spacing between aperture columns are generally varied as a function of the spacing between the mask 36 and the screen 30. For the simplified case of a screen located on a flat faceplate panel and a flat uncorrugated mask, the aperture spacing varies according to the following equation, to obtain proper nesting of screen elements.

$$a' = \frac{3q'S}{L}$$

where:

a'—the horizontal spacing between aperture columns.

q'—the distance between the mask and the screen in the direction of the electron beam path.

L—the distance along the electron beam path from the electron beam deflection center to the screen.

S—the spacing between a center and outer beam at the deflection plane.

Figure 3:
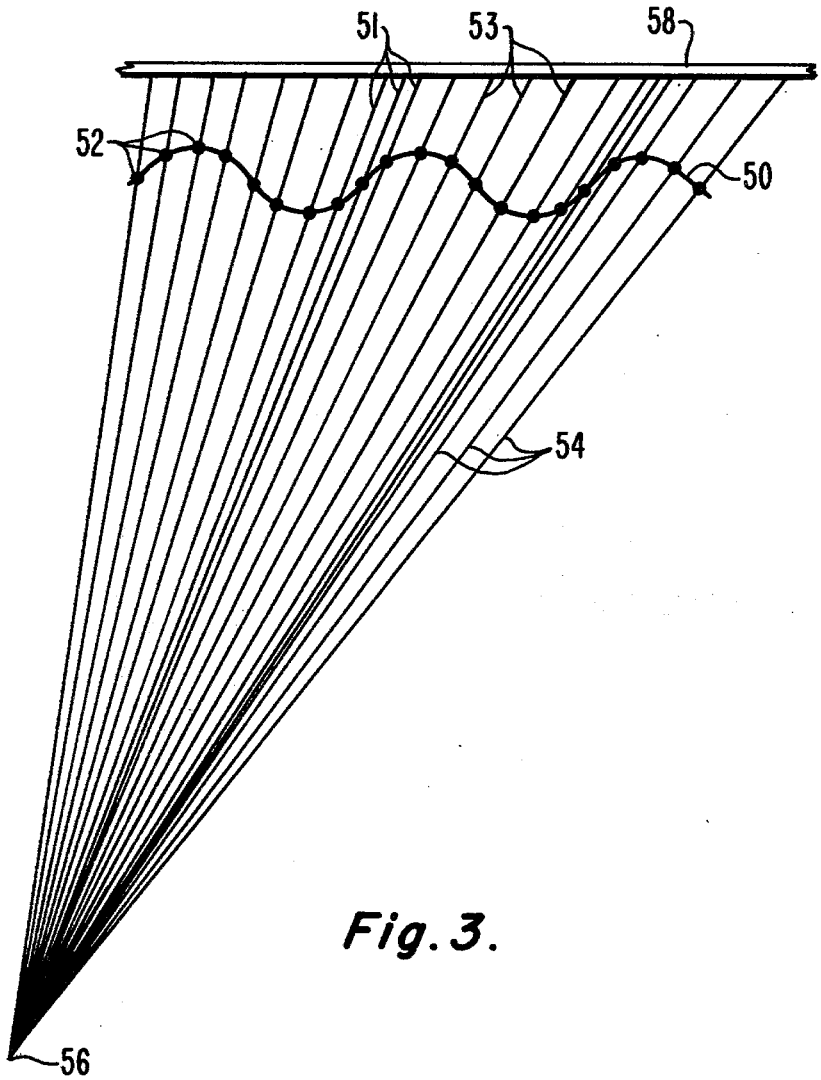
FIG. 3 is a sketch illustrating the effect of uniform spacing of apertures in a corrugated mask.

In order to illustrate one of the problems solved by the present invention, a portion of a corrugated shadow mask 50 is shown in FIG. 3 with apertures spaced at evenly divided distances measured along the surface contour of the mask. For simplification, the variation in horizontal spacing between aperture columns which is a function of mask-to-screen spacing is omitted from this illustration so that the effect of obliquity can be more easily seen. In FIG. 3, the dots 52 on the mask 50 indicate the centers of apertures and the lines through the apertures represent the central portions of electron beams 54 that pass through the aperture centers. Although the electron beams 54 are shown as being emitted from a spatially fixed point source 56 in the deflection plane, it should be understood that such is not the actual case but rather is only a simplified representation. From the illustration, it can be seen that the electron beams 54 form angles with the shadow mask 50 which are a function of both the mask contour and the deflection angle. Because of the constant column-to-column aperture spacing shown, the spacing between electron beams 51 that pass through apertures 52 in portions of the mask 50 with a large angle between the beam and a perpendicular to the mask surface are relatively compressed at the screen 58 compared to the spacing between beams 53 passing through the mask 50 at areas where the angle between the beam and a perpendicular to the mask surface is small. Therefore, uniform aperture spacing on the mask 50 produces a nonuniform spacing pattern of lines on the screen 58.

Figure 4:
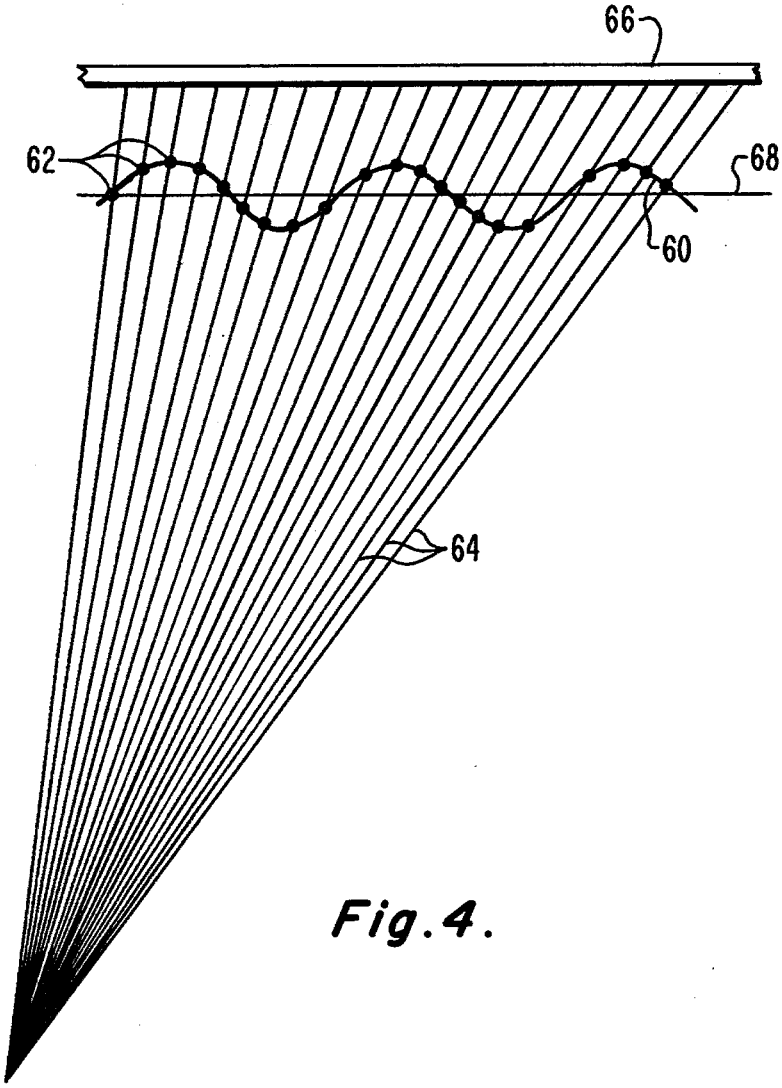
FIG. 4 is a sketch illustrating an improvement achieved by varying aperture spacing in accordance with one aspect of the present invention.

A modified aperture pattern to obtain a desired distribution of lines on the screen 66 is illustrated in FIG. 4. A mask 60 is shown wherein the locations of apertures 62 are spaced as a function of electron beam angle of incidence relative to the mask. Such spacing can also be expressed both as a function of deflection angle of the electron beams 64 and as a function of the angle formed between the mask 60 and a central contour 68 passing through the mask 60 which is the contour which the mask would assume if its corrugation amplitude was reduced to zero. Such contour may include curved contours, such as spherical, cylindrical or aspherical, as well as flat contours.

Figure 5:
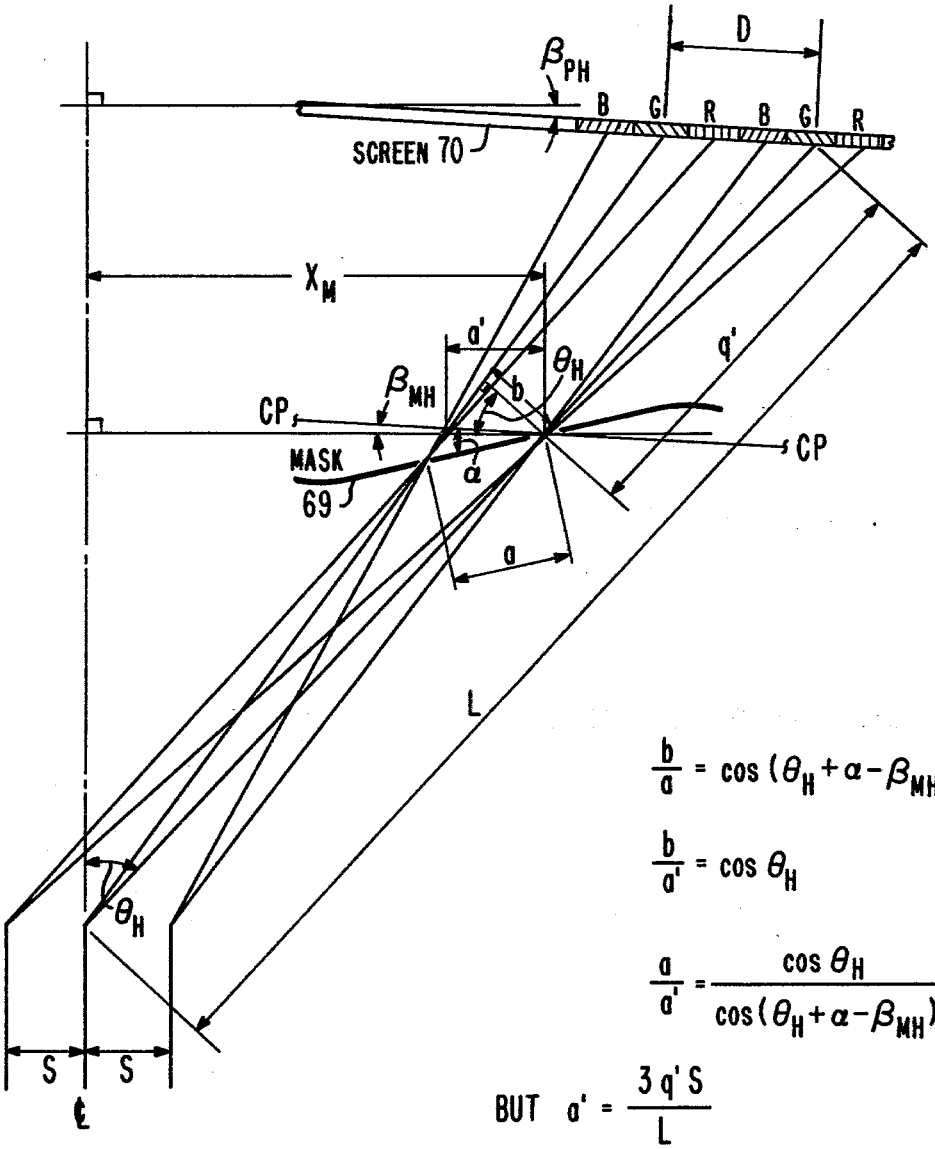
FIG. 5 is a sketch for illustrating the geometric relationships encountered with a corrugated mask.

The relationship of aperture column spacing "a" to the horizontal component of the deflection angle $\theta_H$, and other system parameters, is shown in FIG. 5. In this drawing, representing a horizontal section along the major axis, a corrugated shadow mask 69 is positioned adjacent to a phosphor screen 70.

The screen 54 is formed of red R, green G, and blue B phosphor elements. The various notations in the drawing are defined as follows.

D=the distance along a tangent to the phosphor screen between the centers of two phosphor elements of the same light emitting color.

CP=the central contour passing through the mask about which the mask contour varies to form corrugations.

L=the distance from the electron beam deflection center to a point on the screen.

q'=the distance between the mask and the screen in the direction of the electron beam path.

a'=the center-to-center horizontal spacing between aperture columns as projected by an electron beam onto a plane perpendicular to the tube central longitudinal axis.

S=the spacing between a center beam or tube central longitudinal axis and an outer beam at the deflection plane.

$\theta_H$=the component of the electron beam deflection angle, in a horizontal plane.

$\alpha$=the angle in the horizontal plane between tangents to the shadow mask surface and the central contour through the mask.

a=the center-to-center horizontal distance between mask aperture columns measured along a line tangent to the mask at one of the aperture columns.

b=the horizontal distance between electron beams passing through adjacent aperture columns measured perpendicular to one of the electron beams.

$\beta_{PH}$=the horizontal component of the angle between a tangent to an element of the screen surface and a plane perpendicular to the tube central longitudinal axis (for purpose of simplification, this component is omitted from the following discussion although it must be considered for curved screens).

$\beta_{MH}$=the horizontal component of the angle between a tangent to the mask central contour and a plane perpendicular to the tube central longitudinal axis.

The "a" spacing is derived as follows:

$$a' = \frac{3\,q'\,S}{L}$$

$$b = a' \cos\theta_H = \frac{3\,q'\,S}{L} \cos\theta_H = a \cos(\theta_H + \alpha - \beta_{MH})$$

$$a = \frac{a' \cos\theta_H}{\cos(\theta_H + \alpha - \beta_{MH})} = \frac{3\,q'\,S}{L} \quad \frac{\cos\theta_H}{\cos(\theta_H + \alpha - \beta_{MH})}$$

where the variation of the mask about its central contour is defined by:

$$K \cos\frac{2\pi X_M}{\lambda}$$

$$\text{and } \alpha = \tan^{-1}\left[-\frac{2\pi K}{\lambda} \sin\frac{2\pi X_M}{\lambda}\right]$$

where:

$\lambda$=the peak-to-peak wavelength measured in the direction $X_M$.

2K=the peak-to-peak mask amplitude variation measured about the central contour.

$X_M$=the horizontal distance from the tube central longitudinal axis to a point on the mask measured in a plane perpendicular to the tube central longitudinal axis.

The peak-to-peak wavelength dimension of the corrugated variation in the mask should be at least twice as great as the spacing between adjacent aperture columns.

Figure 6:
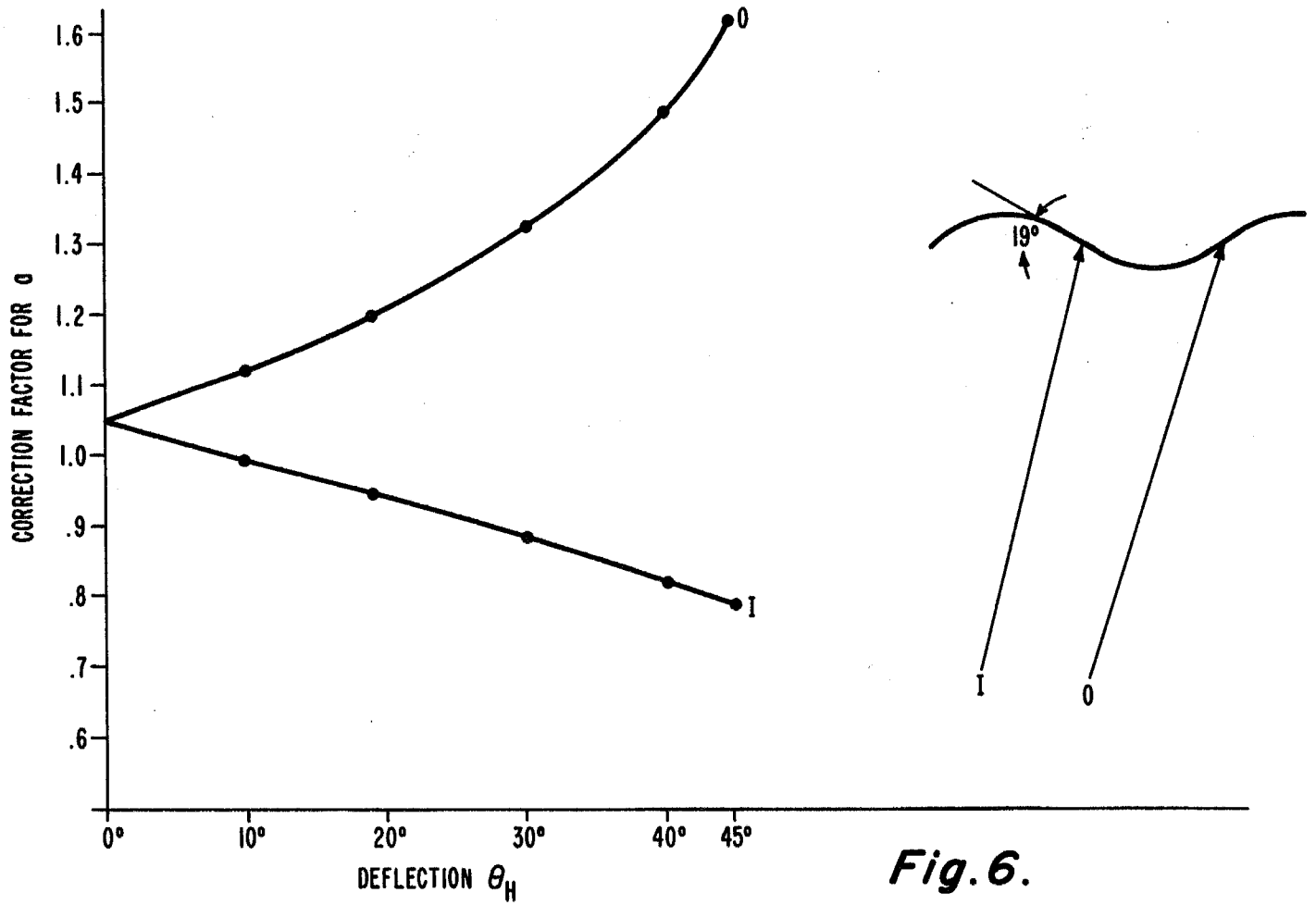
FIG. 6 is a graph of a correction factor for aperture spacing at two different regions of a corrugated mask.

In the foregoing equation for "a", the term $$\frac{\cos\theta_H}{\cos(\theta_H + \alpha - \beta_{MH})}$$

is the correction factor for obliquity for the particular case of a central contour CP having an intercept with a horizontal plane which is a straight line. The value of this correction factor is plotted versus horizontal deflection angle $\theta_H$ in FIG. 6 for inflection points on a mask that has an angle $\alpha_{Max} = \pm 19°$. One plotted line "I" indicates the correction necessary at inflection points with minimum obliquity (shown in the insert) and the other line "O" indicates the correction necessary for inflection points with maximum obliquity (also shown in the insert). As deflection angle increases, the "I" line drops below its initial value since the electron beam becomes more nearly perpendicular to the mask whereas the "O" line increases since the angle between the electron beam and mask increases with deflection angle.

Figure 7:
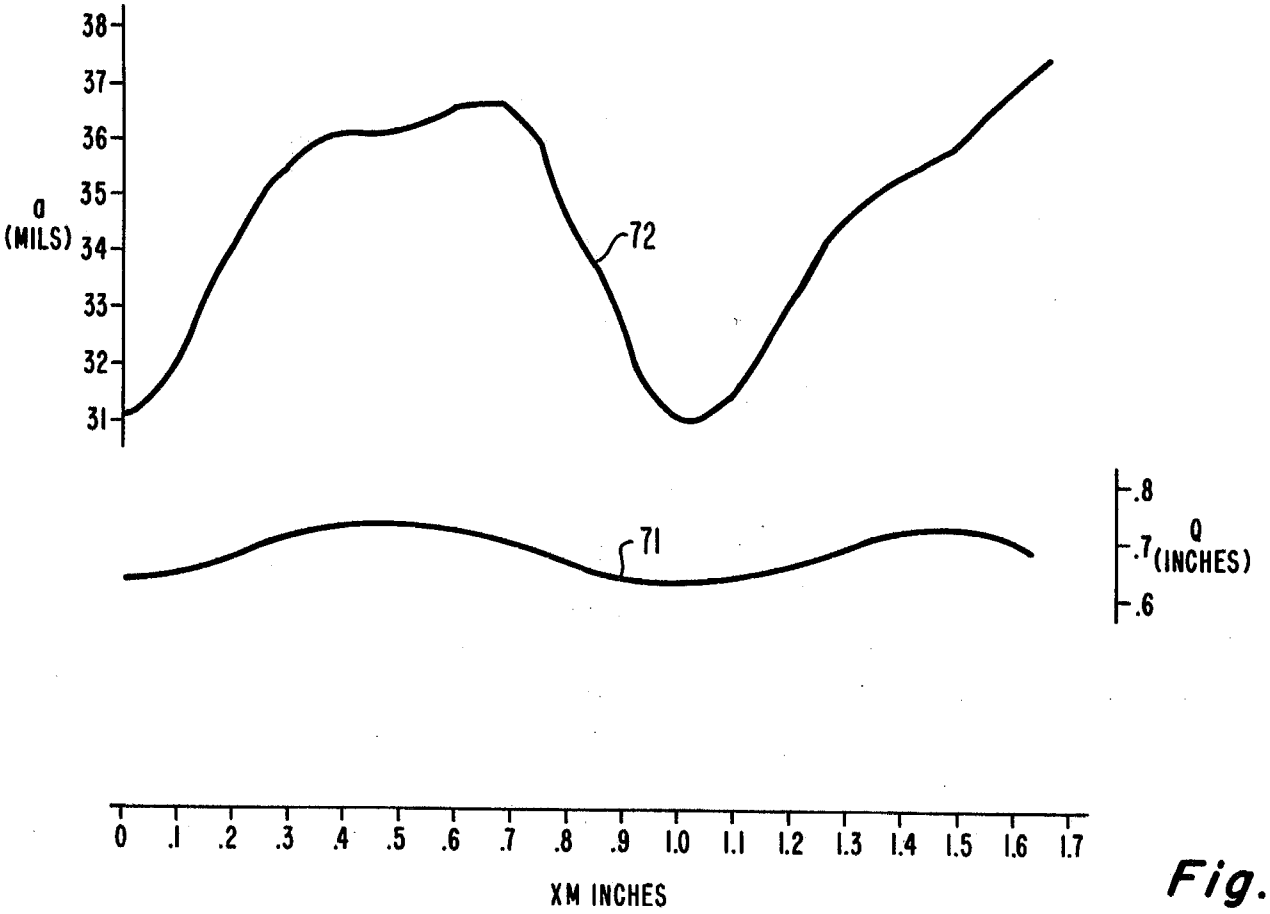
FIG. 7 is a graph showing mask shape and aperture spacing over a small section of a corrugated mask.

FIG. 7 shows a shadow mask contour 71 and an aperture spacing curve 72 for the mask contour 71. The curve 72 contains both the variation which is related to mask-to-screen spacing as well as the correction for obliquity. Since the aperture spacing curve 72 covers a mask area where electron beam deflection is less than 10 degrees, curve 72 is only slightly skewed relative to a mask corrugation peak. As deflection angle increases, the skewing of curve 72 will also increase.

Figure 8:
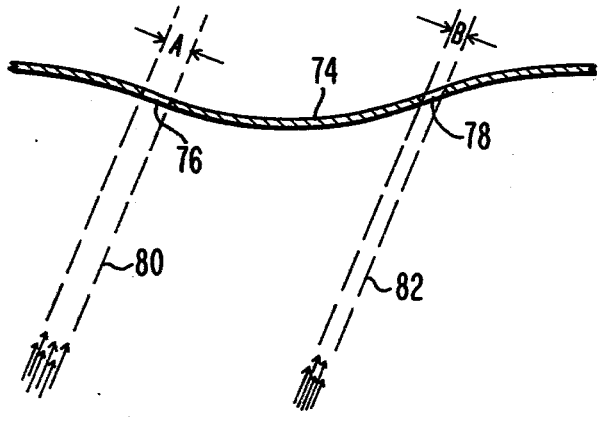
FIG. 8 is a sketch illustrating electron beam passage through a corrugated mask having uniformly sized apertures.

In addition to the obliquity correction required in aperture spacing in a corrugated shadow mask, an obliquity correction is also required in aperture width to maintain a desired electron beam transmission. FIG. 8 shows a portion of a simplified corrugated shadow mask 74, having two apertures 76 and 78. (It should be understood that the density of apertures in a corrugated mask is far greater and that only two apertures are shown for illustrative purposes only). Both of the apertures 76 and 78 have the same identical width as measured tangent to the surface of the mask 74. Portions of electron beams that pass through each aperture 76 and 78 are shown by the dashed lines 80, and 82, respectively. As can be seen, the width A of the electron beam passing through the aperture 76 is much greater than the width B of the electron beam passing through the aperture 78. Therefore, to ensure the desired excitation of the screen, the size of the apertures must be modified in a manner similar to that by which the "a" dimension was modified.

Figure 9:
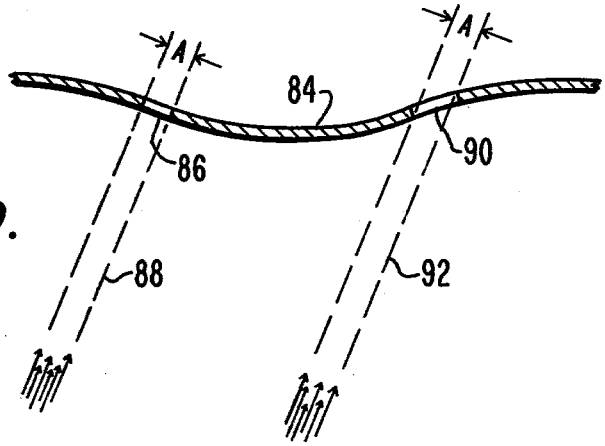
FIG. 9 is a sketch illustrating electron beam passage through a corrugated mask having aperture width varied in accordance with one aspect of the present invention.

A mask 84 having an aperture size correction for obliquity is shown in FIG. 9. One aperture 86 is the same width as the aperture 76 of the mask 74 of FIG. 8 and therefore transmits the same width A of an electron beam defined by lines 88, which is approaching at the same angle as in the previous example. The other aperture 90, however, is widened to the extent that it too transmits an electron beam portion defined by lines 92, of width A. It can be seen that the width correction is dependent on the angle the electron beam makes with the shadow mask at the location of a particular aperture. This angle is a function of the angle between the mask portion and a central contour through the mask, the tilt of the central contour, and the electron beam deflection angle. Therefore, the obliquity correction for aperture width is very similar to the obliquity correction required in aperture spacing and can be determined from the following equation.

$$w = w' \frac{\cos\theta_H}{\cos(\theta_H + \alpha - \beta_{MH})}$$

For a central contour CP having an intercept with a horizontal plane which is a straight line, this equation reduces to the following equation.

$$w = w' \frac{\cos\theta_H}{\cos(\theta_H + \alpha)}$$

Where w' is the aperture width projected by the electron beam onto a plane perpendicular to the tube central longitudinal axis and is a function of a' and the desired electron beam transmission.

Figure 10:
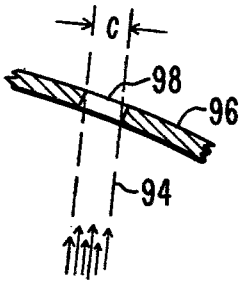
FIG. 10 is a sketch illustrating electron beam passage through a thin mask.
Figure 11:
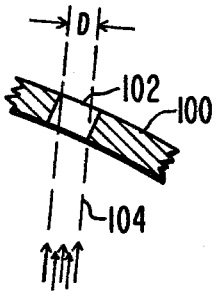
FIG. 11 is a sketch illustrating electron beam passage through a thicker mask having the same aperture width as the aperture in the mask of FIG. 10.
Figure 12:
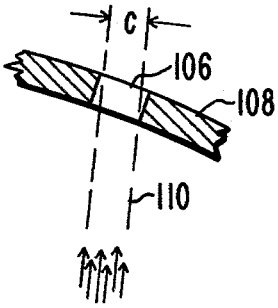
FIG. 12 is a sketch illustrating electron beam passage through a mask of the same thickness as the mask of FIG. 11 but having a larger aperture therein.

There is another obliquity problem that can be corrected by aperture width variation. This problem is related to the thickness of the mask material, or step height at the aperture edge. When an electron beam approaches a mask perpendicularly mask thickness is no problem, however, when the electron beam approaches at any angle other than perpendicular, the thickness of the mask must be considered. FIG. 10 shows an electron beam 94 approaching a mask 96 at a slight angle. The resultant width C of the beam 94 passed through an aperture 98 of the mask 96 is slightly narrower than the width of the aperture 98 because of obliquity. A thicker mask 100 having the same width aperture 102 is shown in FIG. 11. Because of this increased thickness, the width D of the electron beam 104 passing through the aperture 102, at the same angle of beam incidence is reduced. Therefore, the width of an aperture 106 of a mask 108 is increased to permit the same transmission of an electron beam 110, as shown in FIG. 12. For a given uniform mask thickness, this correction for effective mask thickness or aperture step height is again a function of electron beam incidence relative to any particular portion of a mask. Such angle of incidence can again be related to the angle the angle makes with respect to a central plane through the mask the tilt of the central contour and the deflection angle.

The equation for aperture width including the obliquity correction and mask thickness or step height correction is as follows.

$$w = w' \frac{\cos\theta_H}{\cos(\theta_H + \alpha - \beta_{MH})} + t \tan(\theta_H + \alpha - \beta_{MH})$$

For a central contour CP having an intercept with a horizontal plane which is a straight line, this equation reduces to the following equation.

$$w = w' \frac{\cos\theta_H}{\cos(\theta_H + \alpha)} + t \tan(\theta_H + \alpha)$$

Where t is the effective mask thickness or step height.

We claim:

1. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the corrugated waveform extending in a second direction, said mask including an aperture-to-aperture spacing variation in the second direction which is a function of mask-to-screen spacing, the improvement comprising:

the mask further including a variation in aperture-to-aperture spacing which increases with decreasing electron beam angle of incidence relative to said mask and decreases with increasing electron beam angle of incidence relative to said mask.

2. In an apertured mask type color picture tube having a faceplate, a cathodoluminescent screen on the faceplate, a corrugated apertured mask adjacent to the screen and electron gun means for producing a plurality of electron beams and directing said beams through said mask to impinge upon said screen wherein the mask corrugations are substantially parallel and extend in a first direction with the corrugated waveform extending in a second direction, said mask including an aperture width variation in the second direction which is a function of mask-to-screen spacing, the improvement comprising the mask further including a variation in aperture width which increases with decreasing electron beam angle of incidence relative to said mask and decreases with increasing electron beam angle of incidence relative to said mask.

3. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the corrugated waveform extending in a second direction, said mask including an aperture-to-aperture spacing variation and an aperture width variation in the second direction which are functions of mask-to-screen spacing, the improvement comprising, the mask further including variations in aperture-to-aperture spacing and aperture width which increase with decreasing electron beam angle of incidence relative to said mask and decrease with increasing electron beam angle of incidence relative to said mask.

4. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the corrugated waveform extending in a second direction said mask including an aperture-to-aperture spacing variation in the second direction which is a function of mask-to-screen spacing, the improvement comprising the mask further including a variation in aperture-to-aperture spacing which increases with decreasing electron beam angle of incidence relative to said mask and decreases with increasing electron beam angle of incidence relative to said mask, said angle of incidence being a function of (a) deflection angle of the electron beams, (b) the angle in horizontal plane between tangents to the mask surface and a central contour through the mask, and (c) the angle in the horizontal plane between a tangent to the mask central contour and a plane perpendicular to the tube central longitudinal axis, the central contour being the contour to which the mask would shrink if its corrugation amplitude was reduced to zero.

5. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the corrugated waveform extending in a second direction, said mask including an aperture width variation in the second direction which is a function of mask-to-screen spacing, the improvement comprising, the mask further including a variation in aperture width which increases with decreasing electron beam angle of incidence relative to said mask and decreases with increasing electron beam angle of incidence relative to said mask, said angle of incidence being a function of (a) deflection angle of the electron beams, (b) the angle in horizontal plane between tangents to the mask surface and a central contour through the mask, and (c) the angle in the horizontal plane between a tangent to the mask central contour and a plane perpendicular to the tube central longitudinal axis, the central contour being the contour to which the mask would shrink if its corrugations amplitude was reduced to zero.

6. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the varying corrugated waveform extending in a second direction, said mask including an aperture width variation in the second direction which is a function of mask-to-screen spacing, the improvement comprising, the mask further including a variation in aperture width which increases with decreasing electron beam angle of incidence relative to said mask and decreases with increasing electron beam angle of incidence relative to said mask, said angle of incidence being a function of (a) deflection angle of the electron beams, (b) the angle in horizontal plane between tangents to the mask surface and central contour through the mask, and (c) the angle in the horizontal plane between a tangent to the mask central contour and a plane perpendicular to the tube central longitudinal axis, the central contour being the contour to which the mask would shrink if its corrugation amplitude was reduced to zero and said mask including yet another variation in aperture width wherein apertures increase in width proportionally to effective mask thickness at decreasing electron beam angles of incidence.

7. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the varying corrugated waveform extending in a second direction, said mask including an aperture width variation and an aperture-to-aperture spacing variation in the second direction which is a function of mask-to-screen spacing, the improvement comprising, the mask further including variations in aperture width and aperture-to-aperture spacing which increase with decreasing electron beam angle of incidence relative to said mask and decrease with increasing electron beam angle of incidence relative to said mask, said angle of incidence being a function of (a) deflection angle of the electron beams, (b) the angle in horizontal plane between tangents to the mask surface and a central contour through the mask, and (c) the angle in the horizontal plane between a tangent to the mask central contour and a plane perpendicular to the tube central longitudinal axis, the central contour being the contour to which the mask would shrink if its corrugation amplitude was reduced to zero.

8. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the varying corrugated waveform extending in a second direction, said mask including slit-shaped apertures aligned in columns that extend in the first direction, the improvement comprising, the center-to-center spacing between aperture columns being defined by the following equation, $$a = \frac{3\,q'\,S}{L}\;\frac{\cos\theta_H}{\cos(\theta_H + \alpha - \beta_{MH})}$$

where:

a=the center-to-center distance between mask aperture columns measured along a line tangent to the mask at one of the aperture columns q'=the distance between the mask and the screen in the direction of the electron beam path S=the spacing between a center beam or tube central longitudinal axis and an outer beam at the deflection plane L=the distance from the electron beam deflection center to a point on the screen $\theta_H$=the component of the electron beam deflection angle in a horizontal plane $\beta_{MH}$=the horizontal component of the angle between the tangent to the mask central contour and a plane perpendicular to the tube central longitudinal axis $\alpha$=the angle in a horizontal plane between tangents to the shadow mask surface and the central contour passing through the mask which is obtained from the following equation $$\alpha = \tan^{-1}\left[\frac{-2\,\pi\,K}{\lambda}\sin\frac{2\,\pi\,K}{\lambda}\right]$$

where:

$\lambda$=the peak-to-peak wavelength measured in the direction of $X_M$

2K=the peak-to-peak mask amplitude variation measured about the central contour passing through the mask $X_M$=the horizontal distance from the tube central longitudinal axis to a point on the mask measured in a plane perpendicular to the tube central longitudinal axis.

9. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the varying corrugated waveform extending in a second direction, said mask including slit-shaped apertures aligned in columns that extend in the first direction, the improvement comprising, the aperture width being defined by the following equation, $$w = w'\,\frac{\cos\theta_H}{\cos(\theta_H + \alpha - \beta_{MH})}$$

where:

w'=the aperture width projected by the electron beam onto a plane perpendicular to the tube central axis and is a function of a' and the desired electron beam transmission a'=the center-to-center horizontal spacing between aperture columns as projected by an electron beam onto a plane perpendicular to the tube central longitudinal axis $\theta_H$=the component of the electron beam deflection angle in a horizontal plane $\beta_{MH}$=the horizontal component of the angle between the tangent to the mask central contour and a plane perpendicular to the tube central longitudinal axis $\alpha$=the angle in a horizontal plane between tangents to the shadow mask surface and the central contour passing through the mask which is obtained from the following equation, $$\alpha = \tan^{-1}\left[\frac{-2\,\pi\,K}{\lambda}\sin\frac{2\,\pi\,X_M}{\lambda}\right]$$

where:

$\lambda$=the peak-to-peak wavelength measured in the direction of $X_M$

2K=the peak-to-peak mask amplitude variation measured about the central contour passing through the mask $X_M$=the horizontal distance from the tube central longitudinal axis to a point on the mask measured in a plane perpendicular to the tube central longitudinal axis.

10. In an apertured mask type color picture tube having a faceplate, a cathodoluminescent screen on the faceplate, a corrugated apertured mask adjacent the screen and electron gun means for producing a plurality of electron beams and directing said beams through said mask to impinge upon said screen wherein the mask corrugations are substantially parallel and extend in a first direction with the varying corrugated waveform extending in a second direction, said mask including slit-shaped apertures aligned in columns that extend in the first direction, the improvement comprising, the aperture width being defined by the following equation, $$w = w' \frac{\cos \theta_H}{\cos(\theta_H + \alpha - \beta_{MH})} + t \tan(\theta_H + \alpha - \beta_{MH})$$

where:

$w'$=the aperture width projected by the electron beam onto a plane perpendicular to the tube central axis and is a function of a' and the desired electron beam transmission $\theta_H$=the component of the electron beam deflection angle in a horizontal plane $\beta_{MH}$=the horizontal component of the angle between the tangent to the mask central contour and a plane perpendicular to the tube central longitudinal axis t=the effective mask thickness or step height $\alpha$=the angle in a horizontal plane between tangents to the shadow mask surface and the central contour passing through the mask which is obtained from the following equation, $$\alpha = \tan^{-1}\left[\frac{-2\pi K}{\lambda} \sin \frac{2\pi X_M}{\lambda}\right]$$

where:

$\lambda$=the peak-to-peak wavelength measured in the direction of $X_M$

2K=the peak-to-peak mask amplitude variation measured about the central contour passing through the mask $X_M$=the distance from the tube central longitudinal axis to a point on the mask measured in a plane perpendicular to the tube central longitudinal axis.

* * * * *